US011963551B2

(12) United States Patent
Dumen

(10) Patent No.: US 11,963,551 B2
(45) Date of Patent: Apr. 23, 2024

(54) AEROSOL-GENERATING DEVICE WITH ADJUSTABLE AEROSOL-GENERATING CAVITY

(71) Applicant: Philip Morris Products S.A., Neuchatel (CH)

(72) Inventor: Oguz Dumen, Izmir (TR)

(73) Assignee: Philip Morris Products S.A., Neuchatel (CH)

( * ) Notice: Subject to any disclaimer, the term of this patent is extended or adjusted under 35 U.S.C. 154(b) by 659 days.

(21) Appl. No.: 15/734,345

(22) PCT Filed: Jun. 6, 2019

(86) PCT No.: PCT/EP2019/064766
§ 371 (c)(1),
(2) Date: Dec. 2, 2020

(87) PCT Pub. No.: WO2019/234142
PCT Pub. Date: Dec. 12, 2019

(65) Prior Publication Data

US 2021/0219612 A1 Jul. 22, 2021

(30) Foreign Application Priority Data

Jun. 7, 2018 (EP) ..... 18176548

(51) Int. Cl.
*A24F 40/42* (2020.01)
*A24F 40/46* (2020.01)
(Continued)

(52) U.S. Cl.
CPC ..... *A24F 40/42* (2020.01); *A24F 40/46* (2020.01); *A24F 40/485* (2020.01); *A24F 40/50* (2020.01);
(Continued)

(58) Field of Classification Search
CPC ..... A24F 40/42; A24F 40/46; A24F 40/485; A24F 40/50; A24F 40/57; A24F 40/20; A24F 40/40
See application file for complete search history.

(56) References Cited

U.S. PATENT DOCUMENTS

2011/0126848 A1* 6/2011 Zuber ..... A24F 40/46 131/329
2011/0290269 A1* 12/2011 Shimizu ..... A24F 40/46 131/330
(Continued)

FOREIGN PATENT DOCUMENTS

CN 105792688 A 7/2016
EP 2 921 065 A1 9/2015
(Continued)

OTHER PUBLICATIONS

Office Action dated Jan. 19, 2022 in corresponding European Patent Application No. 19 728 696.6, 4 pages.
(Continued)

*Primary Examiner* — Abdullah A Riyami
*Assistant Examiner* — Justin M Kratt
(74) *Attorney, Agent, or Firm* — Oblon, McClelland, Maier & Neustadt, L.L.P.

(57) ABSTRACT

An aerosol-generating device is provided, including a device housing having a cavity configured to receive an aerosol-forming substrate; a heating element extending into the cavity and being configured to heat the aerosol-forming substrate received in the cavity; a movable cavity bottom, a position of the movable cavity bottom defining a length of the cavity; and a control configured to move the movable cavity bottom to a selected position within the cavity, the selected position being a longitudinal position at the heating element. An aerosol-generating system including the aero-
(Continued)

sol-generating device, and a method for preparing the aerosol-generating device, are also provided.

14 Claims, 2 Drawing Sheets

(51) Int. Cl.

| | |
|---|---|
| ***A24F 40/485*** | (2020.01) |
| ***A24F 40/50*** | (2020.01) |
| ***A24F 40/57*** | (2020.01) |
| *A24F 40/20* | (2020.01) |
| *A24F 40/40* | (2020.01) |

(52) U.S. Cl.
CPC ..... *A24F 40/57* (2020.01); *A24F 40/20* (2020.01); *A24F 40/40* (2020.01)

(56) References Cited

U.S. PATENT DOCUMENTS

| | | | |
|---|---|---|---|
| 2015/0013696 | A1 | 1/2015 | Plojoux et al. |
| 2018/0007971 | A1 | 1/2018 | Plojoux et al. |
| 2018/0049471 | A1 | 2/2018 | Holoubek et al. |
| 2018/0049472 | A1 | 2/2018 | Mahler et al. |
| 2018/0235278 | A1 | 8/2018 | Mahler et al. |

FOREIGN PATENT DOCUMENTS

| | | | |
|---|---|---|---|
| EP | 3 785 554 | A1 | 3/2021 |
| JP | 2010-178730 | A | 8/2010 |
| JP | 2014-533513 | A | 12/2014 |
| JP | 2018-511316 | A | 4/2018 |
| RU | 2 647 773 | C2 | 3/2018 |
| WO | WO 2013/076098 | A2 | 5/2013 |
| WO | WO 2016/124550 | A1 | 8/2016 |
| WO | WO 2016/124552 | A1 | 8/2016 |
| WO | WO 2017/186455 | A1 | 11/2017 |
| WO | WO 2017/202959 | A2 | 11/2017 |

OTHER PUBLICATIONS

Japanese Office Action dated Apr. 13, 2023 in Japanese Application 2020-567502 (with English Translation), 11 pages.

Russian Search Report dated Oct. 12, 2022 in Russian Patent Application No. 2020143235/03 (with unedited computer generated English Translation), 4 pages.

International Search Report and Written Opinion dated Sep. 16, 2019 in PCT/EP2019/064766 filed on Jun. 6, 2019.

Combined Chinese Office Action and Search Report dated Oct. 25, 2023 in Chinese Patent Application No. 2019800378919 (with English Translation), 20 pages.

* cited by examiner

AEROSOL-GENERATING DEVICE WITH ADJUSTABLE AEROSOL-GENERATING CAVITY

CROSS-REFERENCE TO RELATED APPLICATIONS

This application is a U.S. national stage application of PCT/EP2019/064766, filed on Jun. 6, 2019, which is based upon and claims the benefit of priority under 35 U.S.C. § 119 from European patent application no. 18176548.8, filed Jun. 7, 2018, the entire contents of each of which are incorporated herein by reference.

TECHNICAL FIELD

The invention relates to aerosol-generating devices, in particular to aerosol-generating devices for aerosol-generating articles having different sizes of aerosol-forming substrate. The invention also relates to a method for preparing an aerosol-generating device for use with such articles.

DESCRIPTION OF THE RELATED ART

There are known electronic devices for stick-like consumables to be inserted into a cavity of the device. A plug of aerosol-forming substrate in the consumable is heated by a heating element of the device in order to generate aerosol. The relationship of a length of an aerosol-forming substrate plug and length of a heating element should correlate in order to be able to heat all of the substrate and in order to heat the substrate and not other parts of an article, for example filter parts.

Thus, there is need for an aerosol-generating device that takes care of disadvantages of prior art devices. In particular there is need for an aerosol-generating device providing more flexibility with respect to different sizes of aerosol-forming substrate to be heated.

SUMMARY

According to the invention there is provided an aerosol-generating device. The device comprises a device housing having a cavity for receiving aerosol-forming substrate, for an example of an aerosol-generating article, preferably a rod-shaped article. At least a portion of the article may be accommodated in the cavity. The at least a portion of the article comprises aerosol-forming substrate. Preferably, all of the aerosol-forming substrate of an article is accommodated in the cavity. The device comprises a heating element extending into the cavity for heating the aerosol-forming substrate received in the cavity or for heating an aerosol-forming substrate of the aerosol-generating article received in the cavity. The cavity comprises a movable cavity bottom, the position of the cavity bottom defining a length of the cavity. A control of the device is adapted to move the cavity bottom to a selected position within the cavity. Preferably, the control is activated by a user. Preferably, a user operates a control switch or control button.

BRIEF DESCRIPTION OF THE DRAWINGS

The invention is further described with regard to embodiments, which are illustrated by means of the following drawings, wherein.

DETAILED DESCRIPTION

Figure 1:
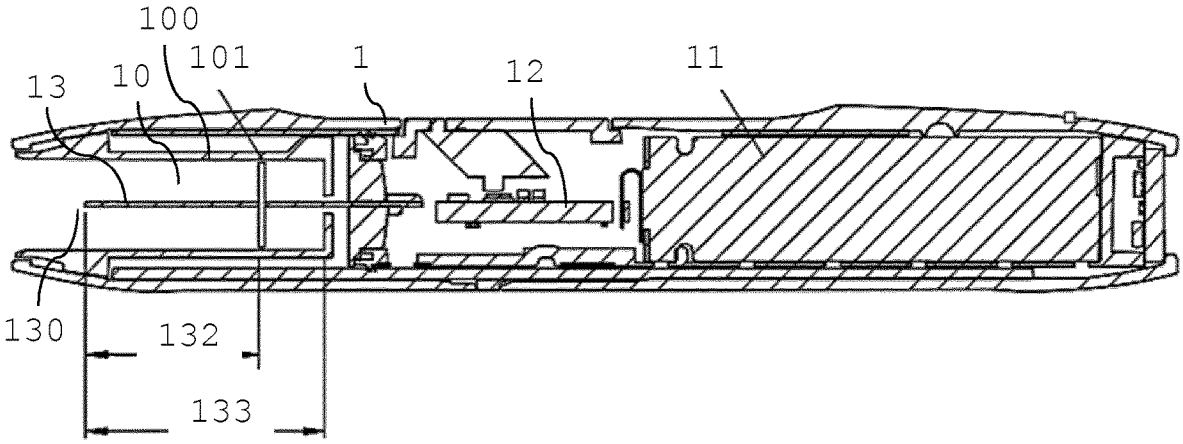
FIG. 1 shows a cross section of an aerosol-generating device with a cavity bottom in an extended position.

The selected position of the cavity bottom is a longitudinal position at the heating element. The movable cavity bottom is movable along the heating element, thus along a length of the heating element. A selected position is preferably a distinct selected position. Preferably, the cavity bottom may be fixed in a selected position, for example such that upon insertion of an aerosol-generating article into the cavity, the cavity bottom is not moved, preferably neither in a distal nor in a proximal direction. Preferably, the cavity bottom is released from a selected position by activating the control, for example by pressing a control button or moving a control switch.

Preferably, a cavity bottom is moved by mechanical means directly attached to the cavity bottom. The mechanical means, for example posts, guide elements or switches, may be moved manually by a user or via drive means. Preferably drive means are electronically controlled by a control in the aerosol-generating device.

Preferably, the movable cavity bottom is selectively movable between at least one extended position and a retracted position. The retracted position corresponds to a maximum length of the cavity. In the retracted position of the cavity bottom a maximum length of an aerosol-forming substrate is insertable into the cavity. Preferably, in the retracted position of the cavity bottom, a maximum length of the heating element is available for heating the aerosol-forming substrate. Preferably, the heating element is in direct contact with the aerosol-forming substrate.

The at least one extended position corresponds to a position between a tip end of the heating element and the retracted position. In an extended position of the cavity bottom the length of the cavity is shorter than its maximum length. In an extended portion of the cavity bottom a length shorter than the maximum length of aerosol-forming substrate is insertable into the cavity. Several extended positions of the cavity bottom correspond to several selectable, preferably distinct positions of the cavity bottom. These several extended positions correspond to different lengths of aerosol-forming substrate being insertable into the cavity and with this being brought into contact with a heating element. Length of cavity and length of heating element in contact with the aerosol-forming substrate may thus be optimized for different lengths of aerosol-forming substrate to be heated. It may thus be prevented that a heating element passes the aerosol-forming substrate and penetrates into, for example, a filter part of an article where possibly an unpleasant taste may be generated upon heating the filter part. It may also be prevented that a longer substrate inserted into a cavity remains without effect with respect to aerosol delivered to a user because that longer part of substrate has no contact to the heating element and may not be heated. A heated part of the longer substrate would not change with respect to a shorter substrate since a heating element is inserted onto the substrate to a same length (or depth).

Preferably, the movable cavity bottom comprises an opening for guiding the heating element in the opening and the cavity bottom along the heating element. Preferably, the opening in the cavity bottom is a central opening arranged in the center of the cavity bottom. Preferably, the opening has a symmetric shape. Preferably, the opening is arranged symmetrically in the cavity bottom.

A cross section of a heating element and a form and size of the opening in the cavity bottom are designed such that the heating element is slidable in the opening of the cavity bottom. Thus, the form and size of the opening is larger than a cross section of the heating element. Preferably, a cross section of the heating element and an opening of the cavity bottom correspond to each other in shape and size such that the cavity bottom neatly fits over the heating element in a slidable manner.

Preferably, the movable cavity bottom is a separate plate. For example, the movable cavity bottom is a disc, comprising the opening for the heating element to extend through the opening.

The heating element comprises at least two heating areas, which are heatable for heating the aerosol-forming substrate in contact with or in vicinity to these heating areas. The heating element may comprise two, three or more heating areas. Preferably, the heating element comprises two heating areas.

Preferably, the at least two heating areas are selectively heatable. Thus, the heating element may be constructed such that each heating area may be heated individually. Preferably, heating of each heating area may individually be controlled. Two or more or all heating areas of a heating element may be connected such that one, two or more or all heating areas may be heated simultaneously.

Preferably, the at least two heating areas are arranged in series along a length of the heating element.

Alternatively, if a two-sided heating element, for example a heating blade is used, one heating area may be arranged on one side of the heating element and another heating area may be arranged on an opposite side of the heating element. Preferably, the two heating areas on the two sides extend over different lengths of the heating blade.

Preferably, a selected position of the movable cavity bottom corresponds to a distal end of a heating area of the heating element. The cavity bottom may thereby be positioned in the retracted position, preferably distal to all heating areas. Or, the cavity bottom may be positioned in an extended position located between two heating areas. Preferably, only the heating area or the heating areas of the heating element, which heating area or areas are arranged proximal to the cavity bottom (versus an insertion end of the cavity) is or are heated.

Aerosol-forming substrate may only be arranged in the cavity down to the cavity bottom. Thus, by restricting a heating to such proximally arranged heating areas, power may be saved and an extended battery power delivery may be achieved. In addition, heating may be restricted to heating areas where aerosol-forming substrate is present. Thus, preferably, portions in a cavity where no substrate is present are not heated.

'Proximal' is understood as a mouth end direction of the device or an end of the device where the aerosol-generating article is inserted into the device. 'Proximal' also defines a position versus a filter end of an aerosol-generating article. Accordingly, 'distal' is understood as an opposite end of the device, opposite the proximal end or opposite the cavity. 'Distal' also defines a position versus an aerosol-generating substrate end of an aerosol-generating article.

The aerosol-generating device comprises a power control. Power may be provided to all heating areas of the heating element or only to one or some heating areas of the heating element. Preferably, the power control is adapted to adjust a power supply to the heating element depending on the selected position of the movable cavity bottom relative to the heating element. Thus, preferably, the power supply to the heating element is made dependent on the position of the cavity bottom arranged along the heating element. Preferably, power into the heating element is adjusted to the size of the heating area or heating areas to be heated. For example, power into the heating element may be reduced when the cavity bottom is in an extended position compared to the power into the heating element when the cavity bottom is in the retracted position.

As a starting process of a heating element, an entire heating element or all heating areas of the heating element may be provided with power and heated. By this, a heating element may be heated faster. However, during the regular smoking process, preferably, only the heating areas in contact with aerosol-forming substrate are activated.

A heating area may be heated to a higher temperature than another heating area. For example, one heating area may be intended to cause release of more aerosol-forming substances from one portion of the substrate than a second heating area from another portion of the substrate. Alternatively or in addition, one heating area may be intended to heat a first type of aerosol-forming substrate and another heating area may be intended to heat a second type of aerosol-forming substrate. The first and second type of aerosol-forming substrate may differ in temperature when a specific substance is released from the different substrates.

Preferably, different heating areas are heatable to a same temperature. Preferably, different heating areas are heatable to a same temperature independent on a size of the heating area. Preferably, different heating areas are heatable to a same temperature by a same power delivered to the heating areas. In particular, a large heating area is preferably heatable to a same temperature as a small heating area.

A heating track or heating tracks forming a heating path in a heating area of the heating element may be varied in size and arrangement, such as for example width of track or length of track. A heating track or heating tracks in each heating area may for example be adapted in size and arrangement, such that with a same power from a power source in the aerosol-generating device a same temperature can be generated in each of the heating areas. Same or different temperatures of different heating areas may also be varied by a specific selection of the material for heating tracks of a heating area on a heating element. For example, platinum, gold and silver may be used in different heating areas to achieve different temperatures due to different electrical resistivity of the materials.

The movable cavity bottom may comprise electrical connections, which electrically connect a power source of the aerosol-generating device to electrical heating tracks of the heating element, in particular to heating tracks of heating areas of the heating element. Preferably, the electrical connections of the cavity bottom are connected to electrical heating tracks of exactly that heating area or those heating areas which are to be heated. Preferably, no electrical connection is established from the power source to heating tracks of heating areas arranged distal to the cavity bottom.

In some embodiments of the device according to the invention, the movable cavity bottom is movable to an extraction position for removing used aerosol-forming substrates from the heating element, preferably for extracting used aerosol-forming substrate from the cavity. Preferably, the extraction position substantially corresponds to a position of the cavity bottom at the tip end of the heating element. Depending on the construction of the cavity and heating element, the extraction position may correspond to an open insertion end of the cavity.

An extended position of the cavity bottom always corresponds to a longer length of the cavity than the extraction position for extracting used substrates. An extended position allows a user to insert a certain length of an aerosol-forming substrate of an article into the cavity and to heat said substrate. In the extraction position the substrate shall be removed from the cavity.

The moving of the cavity bottom along the heating element to the extraction position may have a cleaning function for the heating element as well as for cavity walls.

Preferably, the device has a retracted position, at least one extended position and an extraction position. Preferably, the cavity bottom is movable from the retracted position to the at least one extended position as well as to the extraction position and vice versa.

Preferably, the cavity bottom may be releasably fixed in any of these positions, in the retracted position, in the at least one extended position and in the extraction position.

Preferably, fixing is preformed such that the cavity bottom is not movable, for example when inserting an aerosol-generating article into the cavity, preferably neither in a distal nor in a proximal direction. Preferably, the cavity bottom is releasable from the respective position by activating the control, for example by pressing a control button or moving a control switch or activating a release mechanism such as for example a rotation lock.

Preferably, the heating element is arranged in the axial center of the cavity. Preferably, the heating element extends into the cavity along a longitudinal axis of the cavity.

Preferably, the heating element is a heating blade or a heating pin. Heating blade or heater pin extend through the opening of the movable cavity bottom.

Preferably, a heating element is provided with a pointed tip at the tip end of the heating element for facilitating insertion of the heating element into aerosol-forming substrate.

There is also provided an aerosol-generating system comprising an aerosol-generating device according to the invention and as described herein. An aerosol-forming substrate containing an aerosol-generating article is to be accommodated in the cavity, wherein a distance between the tip of the heating element and the movable cavity bottom corresponds to the length of the aerosol-forming substrate in the aerosol-generating article. When the heating element comprises at least two heating areas, then preferably, the sum of the lengths of the activated heating areas in a length direction of the heating element substantially corresponds to a length of the aerosol-generating substrate in the article. Thus, preferably, the length of the heatable area of a heating element substantially corresponds to a total length of substrate to be heated. By this, no substrate is wasted by not being heatable and no areas of the heating element are heated where no substrate is present.

According to another aspect of the invention there is provided a method for preparing an aerosol-generating device according to the invention and as described herein. The method comprises the steps of moving a cavity bottom of a cavity in a device housing of the aerosol-generating device from a position in the cavity, preferably, a retracted position or an extraction position in the cavity, along and within the length of a heating element of the device to a selected position relative to the heating element thereby defining a length of the cavity, which length is shorter than a maximal length of the cavity.

The selected position is somewhere along the length of the heating element distal to a tip end of the heating element. A selected position does not correspond to the retracted position, which retracted position corresponds to a maximum length of the cavity. A selected position does also not correspond to the extraction position (supporting ejection of used substrates). The heating element extends into the cavity of the device. A subsequent step of the method comprises receiving an aerosol-forming substrate of an aerosol-generating article in the cavity with a length shorter than the maximal length of the cavity, for heating the aerosol-forming substrate by the heating element.

Preferably, the method further comprises the step of supplying power from a power source to the heating element, and adjusting the supplied power dependent on the selected position of the movable cavity bottom relative to the heating element or relative to the cavity, respectively. By this, the size of an area of the heating element to be heated is directly correlated to the position of the cavity bottom and the length of the cavity.

Preferably, the method comprises positioning the cavity bottom at a distal end of a heating area.

The method may comprise fixing the cavity bottom in the extended position, fixing the cavity bottom in the retracted position, fixing the cavity bottom in the extraction position. The method may comprise only one, all or any combination of these fixing steps.

Further features and advantages of the method have been described relating to the aerosol-generating device according to the invention.

FIG. 1 shows an aerosol-generating device comprising a device housing 1. A proximal part of the device housing 1 comprises a cavity 10 for receiving an aerosol-forming substrate, for example of an aerosol-generating article. A distal part of the device housing 1 comprises a battery 11 and printed circuit board (PCB) electronics 12 for operation and control of the device.

Sidewalls of the cavity 10 are formed by inner walls 100 of the device housing 1. Preferably, the sidewalls 100 form a cylindrical cavity for receiving a rod-shaped aerosol-forming substrate. Preferably, the sidewalls 100 of the cavity 10 are formed by the sidewalls of an extractor. The bottom of the cavity 10 is formed by a movable disc 101. The disc 101 is movable in the cavity 10 along a longitudinal axis of the cavity 10.

A heating blade 13 connected to the electronics 12 and the battery 11 extends into the cavity 10. The blade 13 is arranged in the axial center of the cavity 10.

In FIG. 1, the bottom 101 is not arranged in a most retracted position in the cavity 10 but in an extended position in about one third of the length of the blade 13 in the cavity 10.

A distance between the tip 130 of the blade 13 and the cavity bottom 101 in FIG. 1 may be chosen to receive an aerosol-forming substrate having a length of for example 12 mm. The distance between the tip 130 of the blade 13 and the retracted position of the cavity bottom 101 corresponding to a maximum length of the cavity may then be chosen to receive an aerosol-forming substrate having a length of for example 17 mm. Thus a distance 132 between tip 130 and cavity bottom 101 is in the extended position of FIG. 1 about 11.75 mm and a distance 133 between the tip and the retracted position of the cavity bottom is about 16.75 mm.

The cavity bottom 101 can preferably be moved up to the tip 130 of the heating blade 13 but preferably such that the cavity bottom 101 is still in contact with the heating blade 13. In this extraction position of the cavity bottom 101 the aerosol-forming substrate or aerosol-generating article previously in the cavity has been moved substantially out of the cavity 10 by the cavity bottom 101. By this the substrate or article may easily be removed from the cavity 10.

Preferably, the cavity bottom 101 may be fixed in the most retracted position, in the extended position as well as in the extraction position. Such a fixation may be released or overcome, for example by activation of an activation button, a switch or electronic or mechanical release of a fixation mechanism or locking mechanism fixing the cavity bottom in the respective position.

Figure 2:
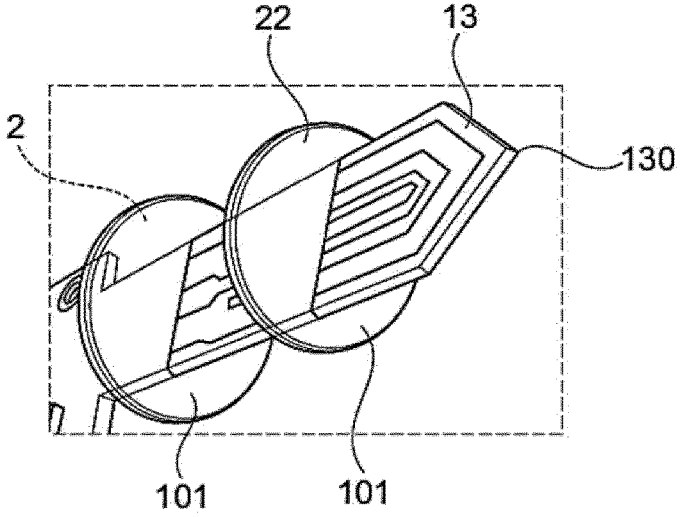
FIG. 2 is a perspective view onto a heating blade with the cavity bottom in a retracted position and in an extended position.

In FIG. 2 a heating blade 13 is shown for illustration purposes with the cavity bottom 101 in a retracted position 2 and in an extended position 22. The cavity bottom 101 comprises a rectangular opening where the blade 13 passes through. The cavity bottom 101 may be moved along the blade 13 from the retracted position 2 to the extended position 22 and vice versa.

Depending on the amount or size of aerosol-forming substrate which is available or which shall be heated, the cavity bottom 101 is positioned along the heating blade 13 leaving more or less surface of the heating blade to come in contact with the aerosol-forming substrate pushed over the heating blade 13. Thus, if the cavity bottom is in the extended position 22, the length of the cavity 10 available for insertion of aerosol-forming substrate is diminished.

Figure 3:
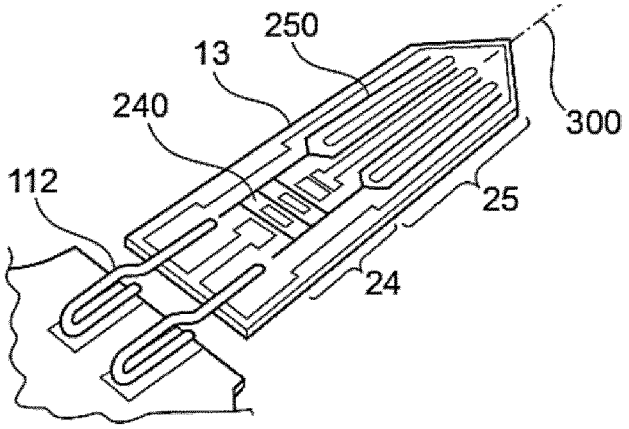
FIG. 3 is a schematic illustration of an example of heating tracks on a heating blade with two heating areas.

FIG. 3 shows an example of a heating blade 13 provided with two heating areas 24,25: one heating area 25 toward the tip 130 or proximal end of the heating blade 13 and one heating area 24 toward the base or distal end of the heating blade 13.

The two heating areas 24,25 create two heating options. One heating option is to heat heating area 25 as such, thus heating only about two/third of the surface area of the heating blade 13. The second heating option is to heat both heating areas 24 and 25, thus the entire surface of the heating blade 13 (except where the heating blade is not arranged in the cavity and is contacted to the electronics).

A length of the heating area 25, wherein the length is measured along the longitudinal axis 300 of the blade 13, may be used to heat a short substrate plug, for example a short tobacco plug, and the length of the combined heating area 24 and 25 may be used to heat a longer substrate plug, for example a longer tobacco plug.

Preferably, a length of the heating area 25 corresponds to a length of a substrate plug of regular heat sticks used in the device, for example a length of aerosol-forming substrate of 12 mm (or about 6 grams for about 14 puffs). Thus, the heating area 24 and 25 then preferably corresponds to a length of a substrate plug of extra-large sticks, for example a length of aerosol-forming substrate of 17 mm (or about 8.5 grams for about 18 puffs).

The part of the blade 13 shown in FIG. 3 provided with electrical contacts 112 is not arranged in the cavity 10 and is preferably not heated.

The blade 13 is provided with heating tracks 240, 250 forming heating paths for heating the respective heating areas 24, 25 of the heating blade 13. In the example of FIG. 3, the resistive tracks 240 are arranged transversal to the longitudinal axis 300 of the heating blade 13 in the heating area 24 and the resistive tracks 250 are arranged parallel to the longitudinal axis 300 of the heating blade 13 in the heating area 25.

While this is an example for two heating areas, other arrangements of heating tracks are possible for two or more heating areas. In particular, length, width and arrangement of the heating tracks may be chosen to achieve a certain temperature in the respective heating areas. In particular, length, width and arrangement of the heating tracks may be chosen in order to achieve a same or different specific temperature(s) in the different heating areas.

Figure 4:
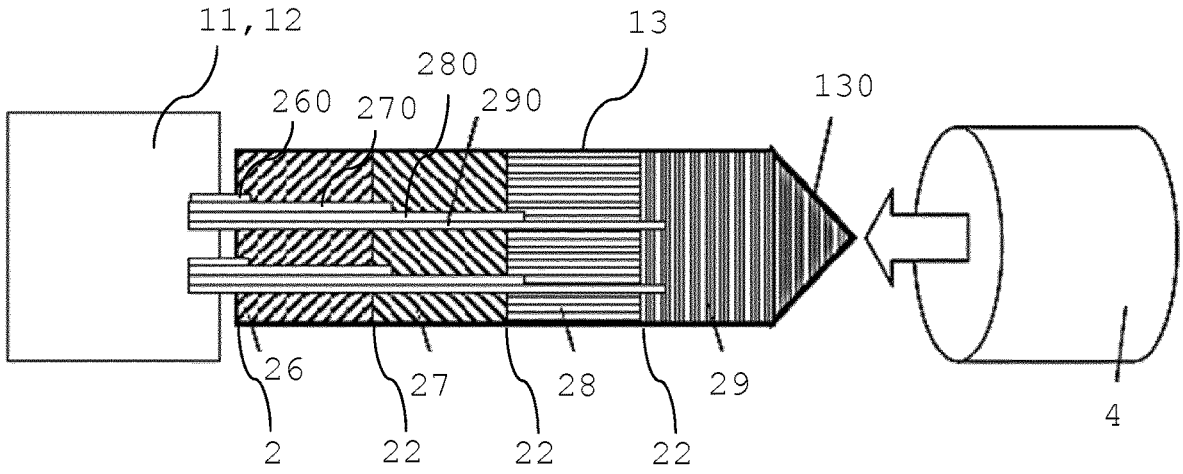
FIG. 4 is a schematic illustration of a heating principle of the present invention.

The schematic illustration of FIG. 4 shows a power and control part 11,12 of a device and a heating blade 13 connected to the power and control part 11,12. A cylindrical aerosol-forming substrate plug 4, for example of a rod-shaped aerosol-generating article, is pushed against the tip 130 of the heating blade 13. Preferably, the substrate plug 4 is positioned over the heating blade 13 such that the entire length of the substrate plug 4 is arranged over the heating blade 13 and in contact with the heating blade 13. The heating blade 13 comprises four heating areas 26,27,28,29 arranged in series along the length of the heating blade 13.

Preferably, the heating areas 26,27,28,29 may individually be activated such as to heat specific parts of the heating blade 13 only. Preferably, the heating areas are individual areas, which delimit heating areas starting from the tip 130 of the blade (heating area 29) where the tip 130 is first inserted into the substrate plug 4, extending to the base of the blade 13 (over heating area 28, then 27 and then 26).

In a preferred embodiment, when, for example, the most distally arranged heating area 26 is activated, all heating areas 27,28,29 between area 26 and tip 130 of the blade are also activated (when heating area 28 is activated, only heating area 29 is also activated). Thus, the cumulated lengths of the different activated heating areas starting from the base of the blade 13 (or from about the middle of the blade in case of activated areas 28 and 29) are the same or similar to preferably the total length of the aerosol-forming substrate plug 4 in an aerosol-generating article. Most preferably, the length of the aerosol-forming substrate plug 4 is slightly longer than the total length of the heating areas such that also the tip 130 of the blade 13 is covered by substrate 4 and that the substrate 4 is heated in a most efficient manner: for one all the substrate is heated and thus substances of all the substrate is made available to a user and secondly, no area is heated without also heating substrate that energy is used only for heating substrate. For example, a substrate is longer by about 0.25 mm than the total length of the accumulated heating area covered by the substrate or than the length of the heating blade in the cavity. Typically, the tip region of the blade 13 is heated together with the tip-most or most proximally arranged heating area 29.

Each heating area 26,27,28,29 and the entire heating blade 13, respectively, are provided with corresponding different connecting resistive heating tracks 260,270,280,290 allowing to selectively activate each heating area 26,27,28,29. The heating tracks 260,270,280,290 are connected to the power and electronics part 11,12 of the device.

Activation of heating areas may in general be managed by the device.

Preferably, a cavity bottom (not shown in FIG. 4) is moved to and positioned at several distinct positions relative to the heating blade 13. There are four selected positions for the cavity bottom 101, wherein the most distal position corresponds to the retracted position 2. If the cavity bottom 101 is positioned in the retracted position 2 the entire length of the heating blade 13 and all heating areas 26,27,28,29 are available for heating an aerosol-forming substrate 4. The other selected positions correspond to different extended positions 22 defining differently sized heated portions of the blade 13. The cavity bottom 101 may be positioned between heating areas, preferably such that exclusively entire heating areas are available for heating substrate. The cavity bottom 101 may be provided with corresponding electrical connections in order to connect the electronics and power part 11,12 exclusively to the heating tracks 260,270,280,290 of heating areas 26,27,28,29 arranged proximal to the cavity bottom. Alternatively, power supply to the heating tracks is electronically controlled by the electronics and power part 11,12 acting on a signal representative to a position information of the cavity bottom.

Figure 5:
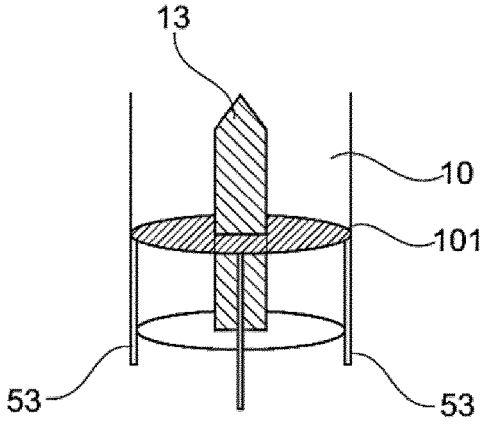
FIG. 5 is a schematic illustration of a moving mechanism of a cavity bottom.

FIG. 5 is an example of a cavity bottom 101 having a disc shape and three regularly arranged posts 53. The posts 53 are attached flush with the circumference of the disc such that the disc may be moved along the cavity 10. A drive mechanism (not shown) in the device is connected to the posts 53 and moves the cavity bottom 101 via the posts 53 along the heating blade 13. Preferably, the device comprises a button, which button when pressed triggers a signal in the electronics of the device, which electronics controls the drive mechanism for moving the cavity bottom 101 to the position in the cavity 10 selected by the button.

Figure 6:
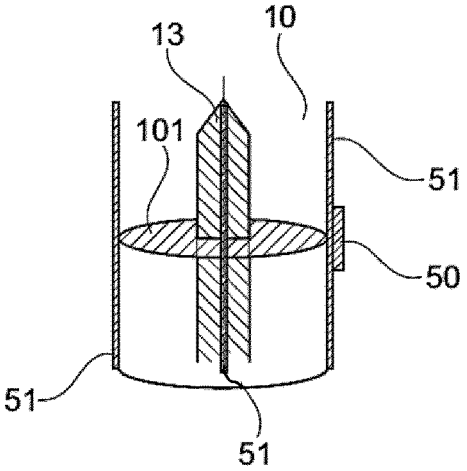
FIG. 6 is a schematic illustration of another moving mechanism of a cavity bottom.

FIG. 6 shows an example of a mechanically moved cavity bottom 101. The cavity walls, for example formed by an extractor or directly by the device housing 1, comprise four guiding tracks 51 arranged longitudinally along the length of the cavity 10 or along a portion of the length of the cavity 10. The guiding tracks 51 are for example grooves or slits for guiding the cavity bottom 101 in the guiding tracks 51.

Figure 7:
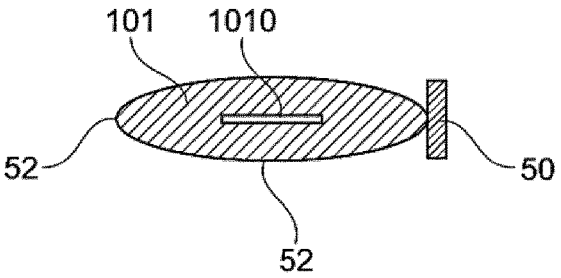
FIG. 7 shows the cavity bottom of the moving mechanism of FIG. 6.

The slits or grooves correspond to guides 50,52 arranged at the circumference of the disc shaped cavity bottom 101. The cavity bottom 101, as shown in more detail in FIG. 7, comprises a centrally arranged rectangular opening 1010 for the heating blade 13 to pass through. The cavity bottom 101 also comprises four guides regularly arranged around the circumference of the disc. Three guides are protrusions 52 extending radially outwardly from the plane of the disc. One guide is a switch 50. The switch 50 may by a manual switch directly operated by a user moving the cavity bottom 101 to its selected position. The switch 50 may also be an internal switch, which is connected to an appropriate mechanical external switch to be operable by a user. In some embodiments it may be advantageous to prevent a direct connection between the cavity 10 and the environment, for example to prevent a direct air path to pass from the environment to the cavity 10.

The invention claimed is:

1. An aerosol-generating device, comprising:

a device housing having a cavity configured to receive an aerosol-forming substrate;

a heating element extending into the cavity and being configured to heat the aerosol-forming substrate received in the cavity;

a movable cavity bottom, a position of the movable cavity bottom defining a length of the cavity;

a control configured to move the movable cavity bottom to a selected position within the cavity, the selected position being a longitudinal position at the heating element; and a power control configured to adjust a power supplied to the heating element depending on the selected position of the movable cavity bottom relative to the heating element.

2. The aerosol-generating device according to claim 1, wherein the movable cavity bottom is selectively movable between at least one extended position and a retracted position, the retracted position corresponding to a maximum length of the cavity, and the at least one extended position corresponding to a position between a tip end of the heating element and the retracted position.

3. The aerosol-generating device according to claim 1, wherein the movable cavity bottom comprises an opening configured to guide the heating element in the opening.

4. The aerosol-generating device according to claim 3, wherein the movable cavity bottom is a separate plate, preferably a disc.

5. The aerosol-generating device according to claim 3, wherein the movable cavity bottom is a disc.

6. The aerosol-generating device according to claim 1, wherein the heating element comprises at least two heating areas.

7. The aerosol-generating device according to claim 6, wherein the at least two heating areas are selectively heatable.

8. The aerosol-generating device according to claim 6, wherein a selected position of the movable cavity bottom corresponds to a distal end of a heating area.

9. The aerosol-generating device according to claim 6, wherein heating tracks in each heating area are configured in size and arrangement such that with a same power from a power source in the aerosol-generating device a same temperature is generated in each heating area of the at least two heating areas.

10. The aerosol-generating device according to claim 6, wherein the movable cavity bottom comprises electrical connections, electrically connecting a power source of the aerosol-generating device to electrical heating tracks of a heating area of the heating element.

11. The aerosol-generating device according to claim 1, wherein the movable cavity bottom is movable to an extraction position configured for removal of the aerosol-forming substrate from the heating element.

12. The aerosol-generating device according to claim 3, wherein the heating element is a heating blade or a heating pin extending through the opening of the movable cavity bottom.

13. An aerosol-generating system, comprising an aerosol-generating device according to claim 1; and an aerosol-forming substrate containing an aerosol-generating article configured to be accommodated in the cavity, wherein a distance between a tip of the heating element and the movable cavity bottom corresponds to a length of the aerosol-forming substrate in the aerosol-generating article.

14. A method for preparing an aerosol-generating device according to claim 1, the method comprising:

moving a cavity bottom of a cavity in a device housing of the aerosol-generating device from a first position in the cavity along a length of a heating element to a selected position relative to the heating element, the heating element extending into the cavity, thereby defining a length of the cavity, the length being shorter than a maximal length of the cavity; and then receiving an aerosol-forming substrate of an aerosol-generating article in the cavity configured for heating of the aerosol-forming substrate by the heating element;

supplying power from a power source to the heating element; and adjusting the supplied power dependent on a selected position of the movable cavity bottom relative to the heating element.

* * * * *